United States Patent [19]

Tanaka et al.

[11] 4,179,617

[45] Dec. 18, 1979

[54] ION-NITRIDING APPARATUS

[75] Inventors: Akio Tanaka, Ono; Mizuo Edamura, Kobe; Satoshi Furuitsu, Kakogawa; Satoru Kunise, Akashi, all of Japan

[73] Assignee: Kawasaki Jukogyo Kabushiki Kaisha, Kobe, Japan

[21] Appl. No.: 855,902

[22] Filed: Nov. 29, 1977

[30] Foreign Application Priority Data

Dec. 1, 1976 [JP] Japan ..... 51-145105

[51] Int. Cl.[2] ..... B01K 1/00

[52] U.S. Cl. ..... 250/531; 148/16.6; 204/177

[58] Field of Search ..... 250/531; 204/177; 148/16.6; 13/31, 32; 118/49.1; 427/39

[56] References Cited

FOREIGN PATENT DOCUMENTS 2125773 12/1972 Fed. Rep. of Germany ..... 13/32

1262897 2/1972 United Kingdom .

*Primary Examiner*—Benjamin R. Padgett

*Assistant Examiner*—Deborah L. Kyle

*Attorney, Agent, or Firm*—Wenderoth, Lind & Ponack

[57] ABSTRACT

An ion-nitriding apparatus wherein heating and nitriding of workpieces can be carried out at high thermal efficiency, with excellent uniformity and in a short time by the combined use of glow discharge and heat generated by a heat-producing element. Heating efficiency can be raised in heating of workpieces by lessening the heat value to be released out of the furnace, and overheating of workpieces can be prevented in nitriding of them by increasing the heat value to be released out of the furnace in proportion to the increase of glow discharge output, and thus the nitriding efficiency can be raised.

6 Claims, 3 Drawing Figures

ION-NITRIDING APPARATUS

BACKGROUND OF THE INVENTION

This invention relates to an improvement on the ion-nitriding apparatus whereby nitrogen as molecules are ionized by glow discharge and nitrogen ions thus produced are made to collide with a workpiece for nitriding treatment.

DESCRIPTION OF THE PRIOR ART

In the conventional apparatus of this kind, firstly glow discharge is produced by impressing DC voltage under vacuum (1–10 Torr) in a vacuum reacting furnace, with a workpiece for treatment as cathode and the furnace wall as anode; secondly nitrogen gas molecules are ionized by the glow discharge; thirdly the workpiece is heated while making the nitrogen ions produced collide with the workpiece; and lastly nitriding is effected while keeping the workpiece at the required treating temperature by glow discharge. Accordingly, if the workpiece to be treated is cold at the initial stage of treatment, glow discharge is unstable and local arc discharge is apt to take place, depending upon the degree of vacuum, gas atmospheric condition, etc., with the result of uneven treatment, more time taken for heating and low efficiency at each cycle. Moreover, even after the required treating temperature (300° C.–570° C.) has been attained, if the workpiece to be treated is of special shape, such as the workpiece having a sharp pointed end or a narrow gap, glow discharge is concentrated upon such a particular part and consequently the temperature of such particular part rises abnormally, and makes it impossible to effect uniform treatment. Also, if the quantity of workpieces to be fed increases, it is necessary to increase the glow discharge output which is necessary for nitriding. On the other hand, if the heat value to be released out of the furnace in the time of the nitriding treatment is small, it involves overheating of the workpiece on the whole, with resultant failure of nitriding.

SUMMARY OF THE INVENTION

In view of the above-mentioned defects of the conventional nitriding apparatus, the present invention contemplates providing an ion-nitriding apparatus of such construction that while heating and nitriding of a workpiece are effected high thermal efficiency can be achieved, in a shorter time and with uniformity by using heat generated by a heat-producing element, as well as the conventional glow discharge. The apparatus is equipped with a blind shutter means (at the outer circumferential side of the heat-producing element) which is shut at the time of heating to lessen the heat value released out of the furnace and thereby raises the heating efficiency and which is opened at the time of nitriding to increase the heat value released out of the furnace in proportion to the increase of glow discharge output, thereby preventing overheating of the workpiece and improving nitriding efficiency.

BRIEF DESCRIPTION OF THE DRAWINGS

The nature and advantages of the present invention will be understood more clearly from the following description made with reference to a preferred embodiment shown in accompanying drawings, in which.

DETAILED DESCRIPTION OF PREFERRED EMBODIMENT

Figure 1:
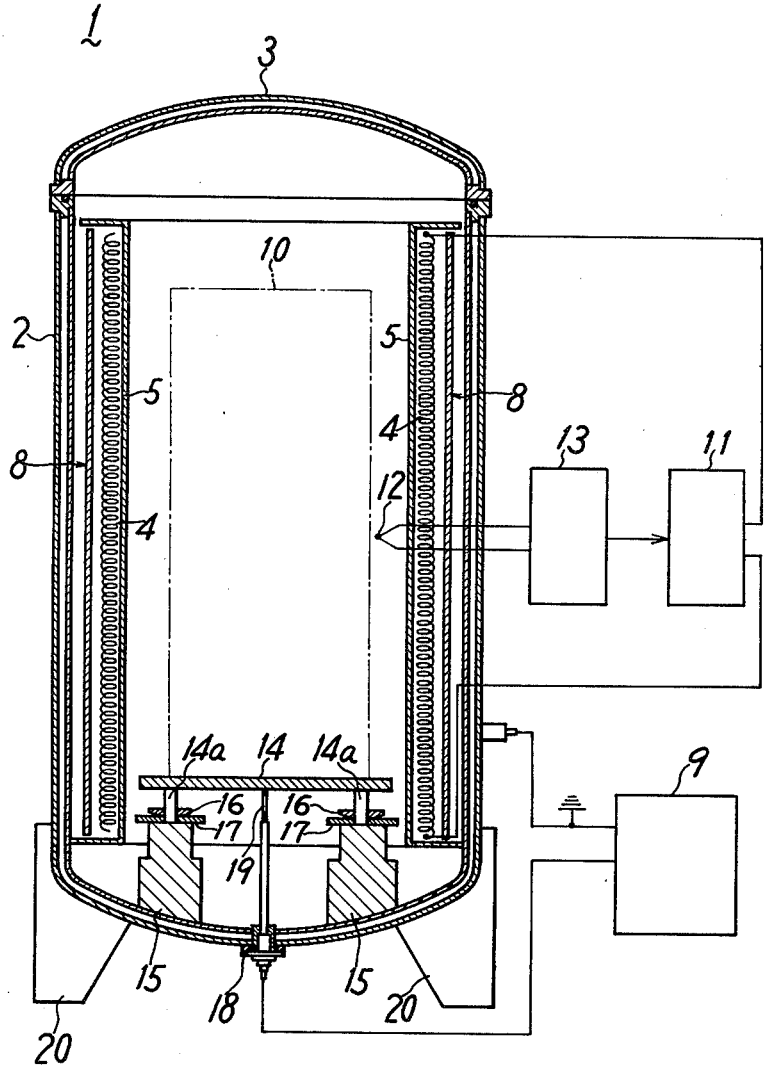
FIG. 1 is a vertical section of the apparatus according to the present invention.
Figure 2:
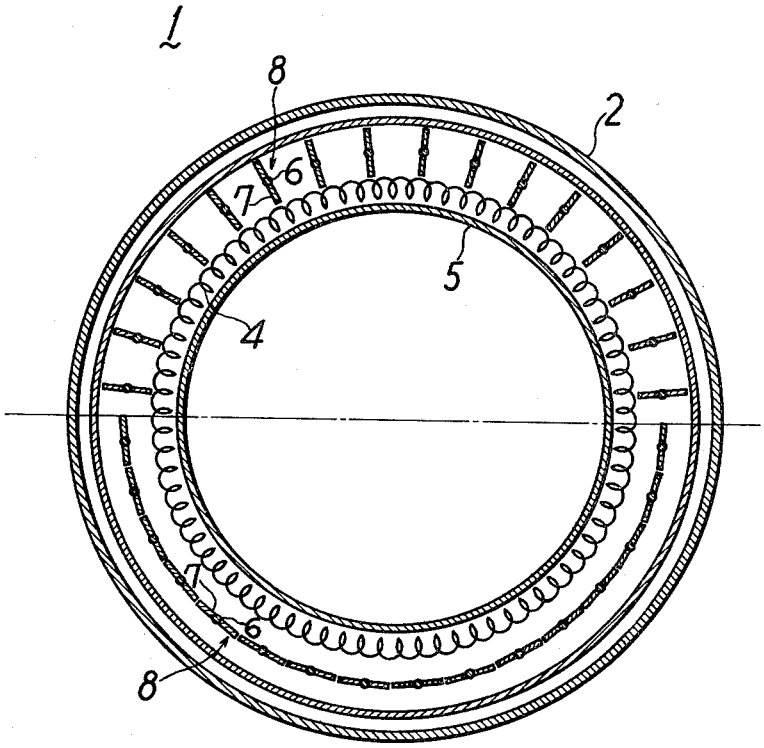
FIG. 2 is a cross section of the apparatus according to the invention.

In FIG. 1 and FIG. 2, a vacuum reacting furnace 1 made of steel is comprised of a cylindrical furnace body 2 and a lid 3 covering an upper opening part (outlet and inlet for workpieces) of the furnace body 2. Both the furnace body 2 and the lid 3 are of water-cooling double construction so that they are kept cooled to the proper temperature. A cylindrical heat-producing element 4 is disposed in the vacuum reacting furnace 1 along the circumference and concentrical with the furnace body 2. A cylindrical screen body 5 is provided at the inner circumferential part of the heat-producing element 4 in such a fashion that it screens, electrically, the inner circumferential side of the heat-producing element 4 from a workpiece (cathode). Provided at the outer circumferential side of the heat-producing element 4 as a means for covering the outer circumference of the heat-producing element 4 is a blind shutter 8 which has on its circumference a number of sash-like blinds 7, each of which is revolvable around its respective vertical axis 6. When the blind shutter 8 is shut, each blind 7 points in a tangential direction so that all blinds are connected together on the circumference and thus enclose the outer circumference of the heat-producing element 4 (refer to the lower half part of FIG. 2), and when the blind shutter 8 is opened, each blind 7 points in a radial direction, thereby opening the outer circumference side of the heat-producing element 4 (refer to the upper half part of FIG. 2). A first power source 9 for glow discharge impresses DC voltage between the anode (the screen body 5) and the cathode (a workpiece to be fed in the vacuum reacting furnace), and a second a power source 11 for a heat-producing element impresses AC voltage upon the afore-mentioned heat-producing element 4. Connected to the second power source 11 is a temperature controller 13 equipped with a thermocouple 12 for temperature measuring inserted into the vacuum reacting furnace 1, whereby temperatures in the furnace 1 are detected to control the second power source 11 for the heat-producing element. A cathode table 14 has a workpiece 10 mounted thereon and is supported by a three-legged supporting stand 15, 15, 15 at the bottom of the vacuum reacting furnace 1. In order to prevent glow discharge from concentrating upon the part at which a leg portion 14a of the cathode mounting table 14 makes contact with the supporting stand 15, an electric-conductive disc 16 with its underside convexed and a disc made of insulating material 17 with its upper side flattened are laid one upon the other so that a wedge-shaped gap is formed between the two. A guide pipe 18 having electric insulating properties and vacuum sealing properties introduces a cathode terminal 19 from outside of the vacuum reacting furnace 1 to the cathode mounting table 14. Numeral 20 is a support leg for the vacuum reacting furnace 1.

Referring to the operation of this apparatus, when DC voltage is impressed by the first power source 9 between the anode (the screen body 5) and the cathode (the cathode mounting table 14, namely, the workpiece 10), glow discharge is generated. On the other hand, when AC voltage is impressed by the second power source 11 upon the heat-producing element 4, heat is generated. By the combined use of this glow discharge and heat generated by the heat-pnoducing element 4, the workpiece 10 is heated to the temperature at which discharge nitriding is possible (300°-570° C., preferably 550°-560° C). Until this treating temperature is attained, the blind shutter 8 is kept shut as shown in the lower half part of FIG. 2 so that heat rays are prevented from going out of the furnace 1 from the outer circumference of the heat-producing element 4 and thus the heat value released is lessened and heating of the workpiece 10 can be done efficiently, in a short time and with uniformity. After the workpiece has been heated to the required treating temperature, nitriding treatment is carried out by glow discharge while keeping the workpiece temperature at the required treating temperature by heat generated by the heat-producing element 4. At this nitriding treatment, glow discharge output is gradually raised in proportion to the quantity of workpieces 10 put in the furnace while the blind shutter 8 is opened as shown in the upper half part of FIG. 2, then heat generated by the heat-producing element 4 is stopped or controlled, whereby the heat value to be released out of the furnace increases with the increase of glow discharge output necessary for nitriding, overheating of the workpiece 10 can be prevented, nitriding efficiency can be raised and nitriding treatment can be done with uniformity. Since the heat-producing element 4 is arranged in such a fashion that it is screened electrically from the workpiece 10 (cathode) by the screen body 5, there is no fear of generating arc discharge or unusual glow discharge between the heat-producing element 4 and the workpiece 10 (cathode). Thus, at the treating temperature, when the temperature of the workpiece 10 is apt to overheat solely by glow discharge while glow discharge output is gradually raised in proportion to the quantity of the workpiece 10 put in the furnace, the blind shutter 8 is opened as shown in the upper half part of FIG. 2, and the heat generated by the heat-producing element 4 is stopped or controlled, whereby the heat value to be released out of the furnace increases and overheating of the workpiece 10 is prevented.

When the temperature of the workpiece 10 is apt to lower solely due to glow discharge while glow discharge output can be reduced, the blind shutter 8 is closed as shown in the lower half part of FIG. 2, and nitriding treatment can be carried out by the combined use of glow discharge and heat generated by heat-producing element 4.

Accordingly, the temperature of the workpiece 10 can be kept easily at the required temperature with excellent uniformity and with accuracy, without regulating the temperature and/or the strength of glow discharge.

Figure 3:
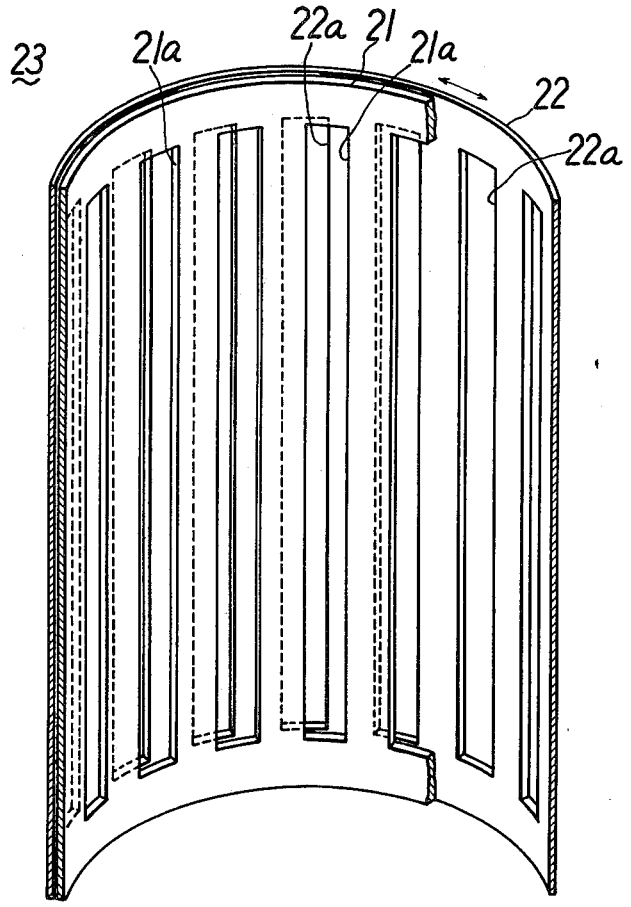
FIG. 3 is a front view of a modified example of a main part of the blind shutter, partly broken away.

The blind shutter 8 may be replaced with a blind shutter 23 as shown in FIG. 3. This blind shutter 23 comprises cylinders 21, 22 which are concentric to each other, each having a number of strip-shaped holes 21*a*, 21*a* . . . and 22*a*, 22*a* . . . at equal spaces in circumferential direction, and which are disposed at the outer circumference of the heat-producing element 4. By coordinating the hole 21*a* and the hole 22*a* by turning either one of the cylinders 21, 22 in one direction, the blind shutter 8 is opened, but is shut if the hole 21*a* and the hole 22*a* are placed out of coordination. The above-mentioned strip-like holes may take the shape of square, rectangle, etc.

The above-mentioned heat-producing element 4 may be divided into two or more vertically and the output of each heat-producing element controlled individually. This has an advantage in that the temperature distribution in the furnace 1 can be maintained in good order and uniformly.

As mentioned above, according to the present invention heating and nitriding of the workpiece can be carried out by the combined use of glow discharge and heat generated by the heat-producing element. This has advantages in that generation of local arc discharge due to local overheating of the workpiece as often experienced in the case of the conventional apparatus can be prevented; heating and nitriding of the workpiece can be done in a shorter time and uniformly; thermal efficiency and treating efficiency per cycle can be raised; the heat value to be released out of the furnace can be reduced by shutting the blind shutter, resulting in improved heating efficiency; and overheating due to the increase of glow discharge output with the increase of the quantity of workpieces to be treated can be prevented by increasing the heat value released out of the furnace with the resultant improvement of nitriding efficiency and uniform nitriding treatment.

What is claimed is:

1. In an ion-nitriding apparatus for heating and nitriding a workpiece, said apparatus having:

a vacuum reacting furnace adapted to receive said workpiece therein;

heating means inside and spaced from the interior wall of said reacting furnace for heating the inside of said furnace;

screening means inside said furnace between the position for said workpiece and said heating means for electrically screening said heating means from said workpiece; and voltage impressing means connected between said screening means as an anode and said workpiece as a cathode for creating a glow discharge, an improvement comprising:

an outer wall covering means within said reacting furnace between said heating means and the interior wall of said furnace for selectively shielding said heating means from and opening said heating means toward said interior furnace wall, whereby the amount of heat released toward said furnace wall is controllable.

2. The improved ion-nitriding apparatus as claimed in claim 1, wherein the outer wall covering means is a blind shutter.

3. The improved ion-nitriding apparatus as claimed in claim 2, wherein said blind shutter is adapted to close when a workpiece is heated by said heating means and to open when a workpiece is subjected to nitriding treatment.

4. The improved ion-nitriding apparatus as claimed in claim 2, wherein said blind shutter has a plurality of vertical axes around the outer circumference of said heating means, and revolvable blind plates are positioned around said vertical axes.

5. The improved ion-nitriding apparatus as claimed in claim 2, wherein said blind shutter is a pair of concentric cylindrical bodies, each body having a number of strip-shaped holes in its circumferential direction, said bodies being disposed at the outer circumference of the heating means and being slidable with respect to each other.

6. The improved ion-nitriding apparatus as claimed in claim 5, wherein one of the two cylindrical bodies is fixed in the vacuum reacting furnace.

* * * * *